US008770574B2

(12) United States Patent
Zhu et al.

(10) Patent No.: US 8,770,574 B2
(45) Date of Patent: Jul. 8, 2014

(54) SERVO EDGE PRESSING PAPER FEEDING DEVICE

(75) Inventors: Yanyou Zhu, Qingdao (CN); Yunlong Zhang, Qingdao (CN); Zonghua Xu, Qingdao (CN)

(73) Assignee: Qingdao Meiguang Machinery Co., Ltd., Qingdao, Shandong (CN)

( * ) Notice: Subject to any disclaimer, the term of this patent is extended or adjusted under 35 U.S.C. 154(b) by 0 days.

(21) Appl. No.: 13/376,353

(22) PCT Filed: May 4, 2011

(86) PCT No.: PCT/CN2011/073658

§ 371 (c)(1),
(2), (4) Date: Dec. 5, 2011

(87) PCT Pub. No.: WO2011/120456

PCT Pub. Date: Oct. 6, 2011

(65) Prior Publication Data

US 2012/0080835 A1 Apr. 5, 2012

(30) Foreign Application Priority Data

Aug. 9, 2010 (CN) ..... 2010 1 0252630

(51) Int. Cl.
*B65H 3/52* (2006.01)

(52) U.S. Cl.
USPC ..... 271/121

(58) Field of Classification Search
USPC ..... 271/10.01, 11, 10.09, 10.11, 90, 99, 271/104, 112, 121, 131, 132, 137, 16, 5, 271/138, 167, 270, 23
See application file for complete search history.

(56) References Cited

U.S. PATENT DOCUMENTS

| | | | | | |
|---|---|---|---|---|---|
| 3,034,784 | A | * | 5/1962 | Lopez | 271/96 |
| 3,962,848 | A | * | 6/1976 | Hankins | 53/284.3 |
| 4,232,859 | A | * | 11/1980 | Tokuno | 271/35 |
| 4,236,708 | A | * | 12/1980 | Matsuo | 271/12 |
| 4,657,236 | A | | 4/1987 | Hirakawa et al. | |
| 4,681,311 | A | | 7/1987 | Sardella | |
| 5,050,852 | A | * | 9/1991 | Sawada et al. | 271/11 |
| 5,074,539 | A | * | 12/1991 | Wells et al. | 271/12 |

(Continued)

FOREIGN PATENT DOCUMENTS

| | | | |
|---|---|---|---|
| CN | 101935959 | A | 1/2011 |
| EP | 0 168 784 | A2 | 1/1986 |

(Continued)

OTHER PUBLICATIONS

International Search Report (PCT/ISA/210) issued on Aug. 18, 2011, by Japanese Patent Office as the International Searching Authority for International Application No. PCT/CN2011/073658.

*Primary Examiner* — Thomas Morrison
(74) *Attorney, Agent, or Firm* — Buchanan Ingersoll & Rooney PC

(57) ABSTRACT

A paper feeding mechanism includes a vacuum absorption variable-speed paper feeding mechanism and a vacuum absorption constant-speed paper feeding mechanism, two edge pressing wheels are installed on a edge pressing paper feeding shaft arranged above a constant-speed paper feeding wheel in the middle, the gaps between the edge pressing wheels and the constant-speed paper feeding wheel in the middle are smaller than the thickness of a paper board, and the distance between the two edge pressing wheels is adjusted by moving on the edge pressing paper feeding wheel shaft.

7 Claims, 3 Drawing Sheets

(56) References Cited

U.S. PATENT DOCUMENTS

| | | | | |
|---|---|---|---|---|
| 5,172,898 | A * | 12/1992 | Takahashi | 271/10.11 |
| 7,192,024 | B2 * | 3/2007 | Sullivan | 271/10.01 |
| 7,621,524 | B2 * | 11/2009 | Levin | 271/123 |
| 7,635,124 | B2 * | 12/2009 | Sardella | 271/10.06 |
| 8,100,397 | B2 * | 1/2012 | Sardella | 271/10.06 |

FOREIGN PATENT DOCUMENTS

| | | | |
|---|---|---|---|
| EP | 1 803 668 | A1 | 7/2007 |
| KR | 10-2007-0067897 | A | 6/2007 |
| WO | WO 01/00514 | A1 | 1/2001 |

* cited by examiner

SERVO EDGE PRESSING PAPER FEEDING DEVICE

FIELD OF THE DISCLOSURE

This invention relates a paper feeding device for printing, grooving and die cutting process of corrugated board process. It belongs to the filed of corrugated board manufacturing facility, and more particularly, is an edge pressing paper feeding device.

BACKGROUND OF THE DISCLOSURE

In the subsequent processing of corrugated cardboard, the formed paper board requires printing, grooving and die cutting, and then is made into corrugated cardboard of different specifications according to national standards to meet requirements of certain load-bearing and capacity. With the development of cartons production line, the dimensional precision and printing quality of the corrugated cardboard needs to be ever higher, thus the precision of the carton printing machinery needs to be ever higher.

The operating principle of the corrugated board feeding device of the existing carton printing machinery is as following: three paper feeding wheel groups are controlled by a cam mechanism, and the paper board is absorbed on the feed rollers via vacuum suction produced by a vacuum air suction box. The paper board is transported between a upper and lower paper feeding wheels by friction force, and then sent to printing portions by clamp force which is produced as gaps between the upper and lower feed rollers are smaller than the thickness of the paper board. Because it is controlled by cam mechanism, three paper feeding wheel groups can not achieve the entire delivery of the corrugated cardboard, and the paper board can not maintain a constant size. The strength of the corrugated board is much reduced because the press of the upper and lower paper feeding wheels on the corrugated board.

DISCLOSURE

In order to solve the existing problem, the present disclosure provides an edge pressing paper feeding device, during sending the corrugated board to printing portions, to avoid the strength reduction produced by being pressed at lager area, and to realize the entire delivery control of the corrugated board, and high feeding precision.

The object of the present disclosure is realized by following solution: a servo edge pressing paper feeding device comprises a paper feeding mechanism consisting of paper feeding wheel groups, and its vacuum air suction boxes, and control system, characterized in that the paper feeding mechanism comprises a vacuum absorption variable-speed paper feeding mechanism consisting of at least three servo variable-speed paper feeding wheel groups and its vacuum air suction box, and a vacuum absorption constant-speed edge pressing paper feeding mechanism consisting of at least three constant-speed paper feeding wheel groups, two edge pressing wheels and its vacuum air suction box, two said edge pressing wheels are installed on a edge pressing paper feeding shaft arranged above a constant-speed paper feeding wheel in the middle, the distance between the two edge pressing wheels is adjusted by moving on the edge pressing paper feeding wheel shaft, and the gaps between the edge pressing wheels and the constant-speed paper feeding wheel in the middle are smaller than the thickness of a paper board.

As an improvement of aforementioned solution: the variable-speed paper feeding wheel groups of said vacuum absorption variable-speed paper feeding mechanism comprises a first servo variable-speed paper feeding wheel group, a second variable-speed paper feeding wheel group, and a third variable-speed paper feeding wheel group, said three variable-speed paper feeding wheel groups are all connected with a servo motor by couplings, and the servo motor is controlled by a servo controller of the control system, a coupling is arranged at the end of the edge pressing paper feeding wheel shaft and connected with a photoelectric encoder, output signal of which is connected to PLC of the control system, and then the output signal of PLC of the control system is connected to the servo controller.

As a further improvement of aforementioned solution: the constant-speed paper feeding wheel groups of said vacuum absorption constant-speed edge pressing paper feeding mechanism comprises a first row of constant-speed paper feeding wheel, a second row of constant-speed paper feeding wheel and a third row constant-speed paper feeding wheel, three rows of constant-speed paper feeding wheel are connected by a synchronous belt to ensure that they are at the same linear speed, and a gear is arranged at the end of the second row of constant-speed paper feeding wheel, engaged with the gear arranged at the end of the edge pressing paper feeding wheel shaft, and the other end of the edge pressing paper feeding wheel shaft is equipped with a big synchronous pulley which is connected with the motor belt pulley at the end of the main motor by synchronous belt.

As a further improvement of aforementioned solution: said edge pressing paper feeding wheels are arranged on the edge pressing paper feeding wheel shaft via a steel ball, wedge-caulking and taper sleeve, and compression nut, the edge pressing paper feeding wheel shaft has measure scale. The edge pressing position can be changed according to the width of the corrugated board.

As a further improvement of aforementioned solution: each of said three servo variable-speed paper feeding wheel groups adopts a set of servo motor and servo controller.

Compared to the prior art, the present disclosure has following advantages and positive results:

The present disclosure adopts a vacuum absorption servo variable-speed paper feeding mechanism and a vacuum absorption servo constant-speed paper feeding mechanism to transport the corrugated board. A servo motor, a servo controller and a photoelectric encoder form a closed-loop control system which sends the entire paper board to the vacuum absorption servo constant-speed paper feeding mechanism according to the length of the corrugated board, thus it improves the feeding precision and feeding efficiency of the paper board. Vacuum air suction boxes are both arranged in servo variable paper feeding stage and constant-speed paper feeding stage, whereas the paperboard is tightly absorbed on the paper feeding wheels and is transported forward by means of friction force. The edge pressing paper feeding wheels only has accessory edge pressing action, thus the pressing action of the edge pressing paper feeding wheels on the corrugated board is reduced, and the strength of the corrugated board can not be substantially reduced. It realizes that carton printing machinery can print without pressing the corrugated board, and enhances the strength of the formed cartons. The edge pressing paper feeding wheels are arranged on the edge pressing paper feeding wheel shaft, and can move on the edge pressing paper feeding wheel shaft to change the pressing position according to the width of the corrugated board.

PREFERRED EMBODIMENTS

Figure 1:
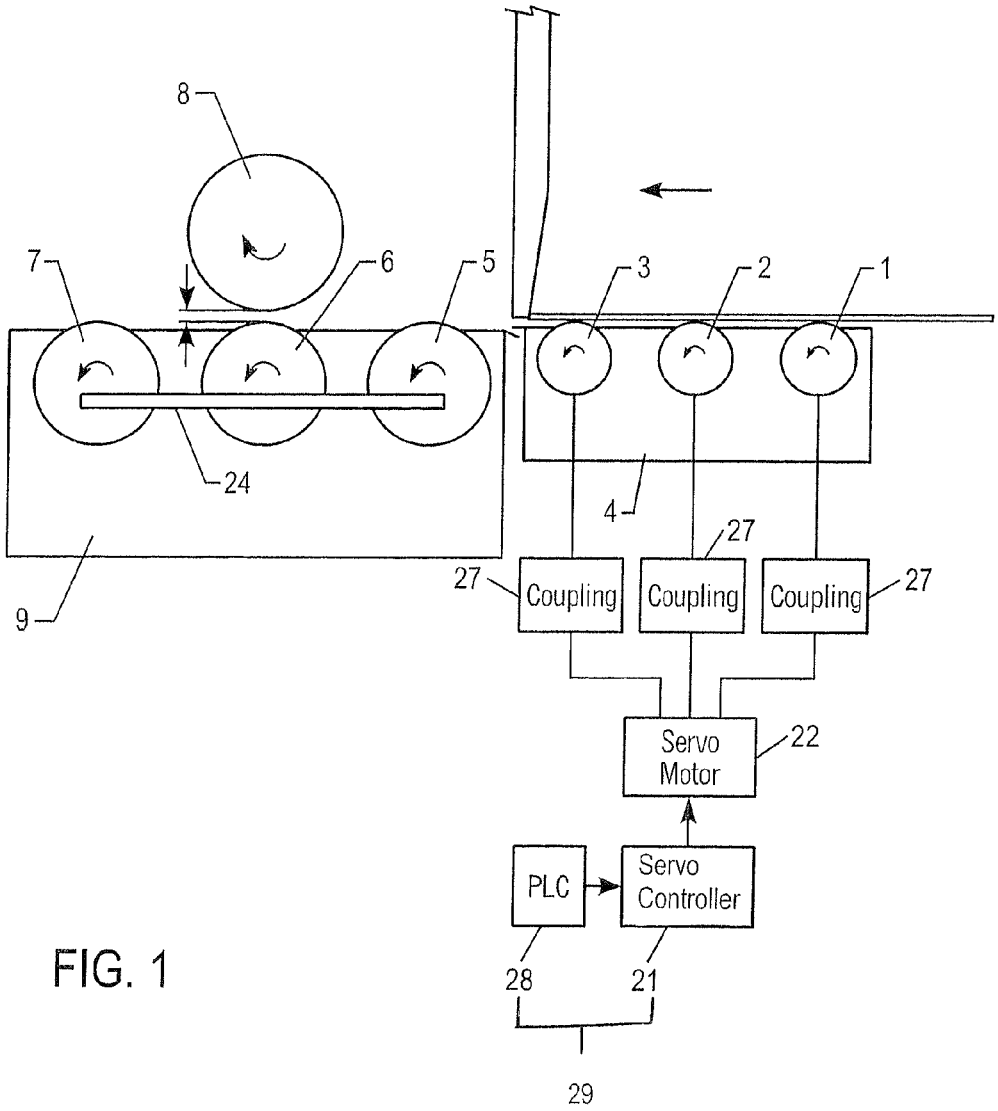
FIG. 1 is a construction view of the servo edge pressing paper feeding device according to an embodiment of the present invention.
Figure 2:
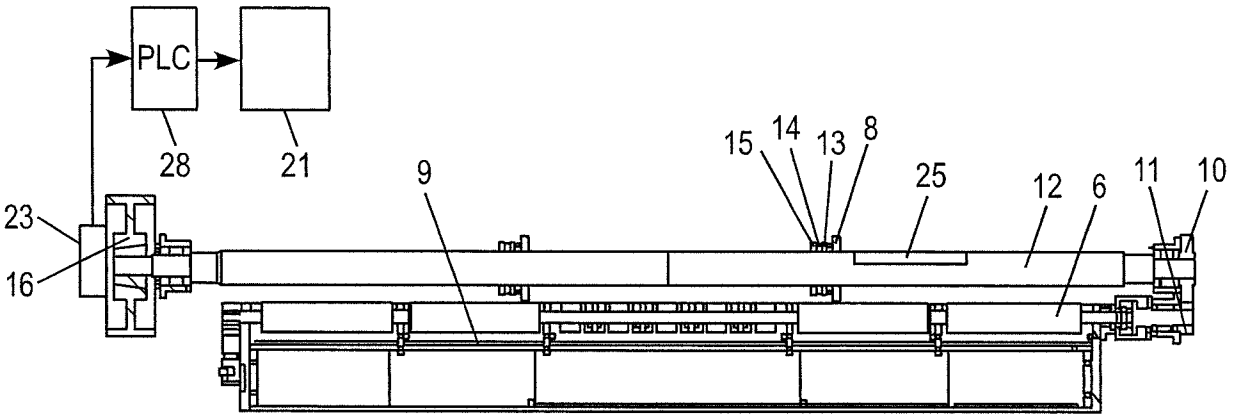
FIG. 2 is a view of the vacuum absorption constant-speed edge pressing of the servo edge pressing paper feeding device according to an embodiment of the present invention.

Referring to FIG. 1 and FIG. 2, as an example, a servo edge pressing paper feeding device, according to an embodiment of the present invention, comprises: a paper feeding mechanism having paper feeding wheel groups, vacuum air suction boxes, and a control system 29. The paper feeding mechanism comprises a vacuum absorption variable-speed paper feeding mechanism consisting of three servo variable-speed paper feeding wheel groups 1, 2, 3 and its vacuum air suction box 4, and a vacuum absorption constant-speed edge pressing paper feeding mechanism consisting of three constant-speed paper feeding wheel groups 5, 6, 7, two edge pressing wheels 8 and its vacuum air suction box 9. Two of said edge pressing wheels 8 are installed on a edge pressing paper feeding shaft 12 arranged above a constant-speed paper feeding wheel 6 in the middle, the gaps t between the edge pressing wheels 8 and the constant-speed paper feeding wheel 6 in the middle are smaller than the thickness of a paper board. Side edge pressing wheels 8 can move on the edge pressing paper feeding wheel shaft 12 and are arranged on the edge pressing paper feeding wheel shaft 12 via a steel ball 13, wedge-caulking and taper sleeve 14, and compression nut 15. The edge pressing paper feeding wheel shaft 12 has measure scale, and edge pressing position can be changed according to the width of the corrugated board. The movement of the edge pressing wheels 8 on the edge pressing paper feeding wheel shaft 12 can be adjusted by manual or electric which needs corresponding mechanical structure and control circuit apparatus.

Figure 3:
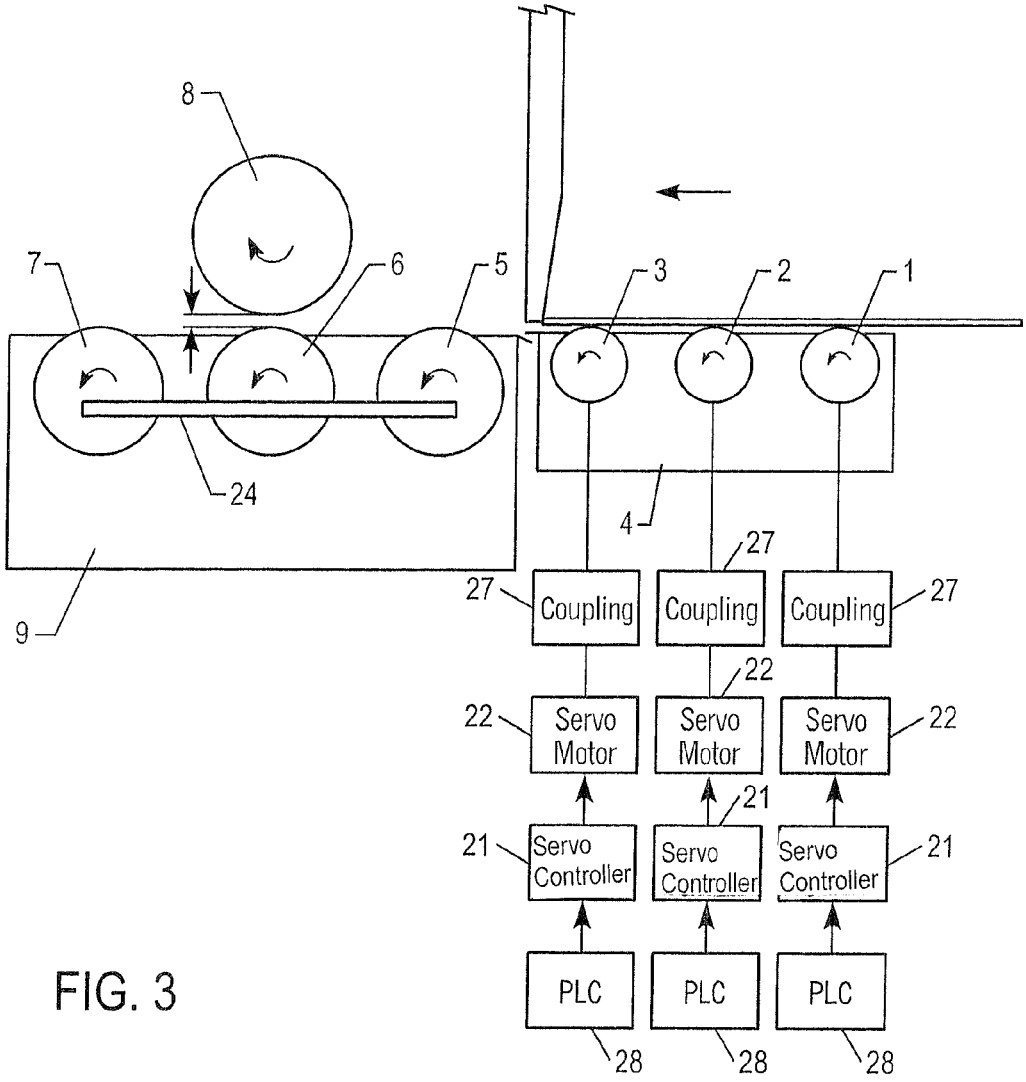
FIG. 3 is a construction view of the servo edge pressing paper feeding device according to an alternative embodiment of the present invention.

The variable-speed paper feeding wheels of said vacuum absorption variable-speed paper feeding mechanism comprises a first servo variable-speed paper feeding wheel group 1, a second variable-speed paper feeding wheel group 2 and a third variable-speed paper feeding wheel group 3. Said three variable-speed paper feeding wheel groups are all connected with a servo motor 22 by couplings 27, and the servo motor 22 is controlled by a servo controller 21, which is in the control system 29. Alternatively, as illustrated in FIG. 3, each of the three variable-speed paper feeding wheel groups 1, 2, 3 may be connected to a respective servo motor 22 and a servo controller 21.

A coupling is arranged at the end of the edge pressing paper feeding wheel shaft and connected with a photoelectric encoder 23, the output signals of which are connected to a PLC 28 of the control system 29, and then the outputs signal of PLC of the control system is connected to the servo controller.

Each said three servo variable-speed paper feeding wheel groups adopts a set of servo motor and servo controller. It also can adopts one set of servo motor and servo controller, the servo variable-speed paper feeding wheel group adopts a hemicycle structure, but the mechanical structure is complex, and control precision is lower.

The constant-speed paper feeding wheel groups of said vacuum absorption constant-speed edge pressing paper feeding mechanism comprises a first row of constant-speed paper feeding wheel 5, a second row of constant-speed paper feeding wheel 6 and a third row constant-speed paper feeding wheel 7. Three rows of constant-speed paper feeding wheel are connected by a synchronous belt 24 to ensure that they are at the same linear speed, and a gear 11 is arranged on the end of the second row of constant-speed paper feeding wheel 6, engaged with the gear 10 arranged on the end of the edge pressing paper feeding wheel shaft 12, and the other end of the edge pressing paper feeding wheel shaft 12 is equipped with a big synchronous pulley 16 which is connected with the motor belt pulley at the end of the main motor by synchronous belt.

The edge pressing paper feeding wheel shaft may have a measure scale 25.

The control method of the servo edge pressing paper feeding device for corrugated board according to the present invention is as following:

Under control of the control system, the corrugated board is transferred from the vacuum absorption servo variable-speed paper feeding mechanism to the vacuum absorption servo constant-speed paper feeding mechanism. At first, because of the action of the vacuum air suction box 4, the corrugated board is tightly absorbed on the servo variable-speed paper feeding wheels 1,2,3 and is transported forward by means of friction force, control program is saved in PLC, the control program makes the three servo variable-speed wheel groups operate like this: they move in modified sine acceleration before the front end of the corrugate board reaching the first row constant-speed paper feeding wheel of the vacuum absorption constant-speed edge pressing mechanism; they move in constant speed after the front end of the corrugate board reaching the first row constant-speed paper feeding wheel 5 of the vacuum absorption constant-speed edge pressing mechanism; and when the tail end of the corrugate board leave the servo variable-speed paper feeding wheels 1,2,3, the three servo variable-speed wheel groups 1,2,3 decelerate and stop in sequence, and the entire delivery of the corrugated board is finished. Because of the action of a vacuum air suction box 9 of the vacuum absorption constant-speed, the corrugated board is tightly absorbed on the paper feeding wheel 5, 6, 7 and is transported forward by means of friction force, pass by a first row of constant-speed paper feeding wheel 5, a second row of constant-speed paper feeding wheel 6 and a third row constant-speed paper feeding wheel 7 to printing portions. The clamp force is produced by the gaps t between the edge pressing wheels 8 and the constant-speed paper feeding wheel 6 in the middle being smaller than the thickness of a paper board and makes the corrugated board accurately moves in constant speed.

Above control system detects the specific phase of the edge pressing paper feeding wheel shaft by a photoelectric encoder 23, and feeds back to PLC, considering the length of the corrugated board, the initial points and shift points of the first servo variable-speed paper feeding wheel group 1, the second servo variable-speed paper feeding wheel group 2 and the third servo variable-speed paper feeding wheel group 3 are worked out by a series of programmable operation, and the servo motor is driven by the servo controller to rotate at setting operating speed.

It is to be understood that above detail is not to limit the present invention, and the invention is not limited to the disclosed embodiments, but, on the contrary, is intended to cover variations, modifications, addition or equivalent arrangements that are within the spirit and scope of the appended claims.

The invention claimed is:

1. An edge pressing paper feeding device comprising a paper feeding mechanism and a control system; wherein the paper feeding mechanism comprises:

a vacuum absorption variable-speed paper feeding mechanism comprising at least a first variable-speed paper feeding wheel group, a second variable-speed paper feeding wheel group, and a third variable-speed paper feeding wheel group, a first vacuum air suction box, and a servo motor;

a vacuum absorption constant-speed edge pressing paper feeding mechanism comprising at least three constant-speed paper feeding wheel groups, two edge pressing wheels and a second vacuum air suction box, and an edge pressing paper feeding wheel shaft;

said two edge pressing wheels are installed on the edge pressing paper feeding wheel shaft, which shaft is arranged above a middle one of the constant-speed paper feeding wheel groups;

a distance between the two edge pressing wheels is adjusted by moving the two edge pressing wheels on the edge pressing paper feeding wheel shaft, and gaps between the edge pressing wheels and the middle one of the constant-speed paper feeding wheel groups are smaller than the thickness of a paper board, wherein:

said three variable-speed paper feeding wheel groups are all connected with the servo motor, and the servo motor is controlled by a servo controller of the control system, and a photoelectric encoder is arranged at an end of the edge pressing paper feeding wheel shaft and an output signal of the photoelectric encoder is connected to a PLC of the control system, and the output signal of the PLC of the control system is connected to the servo controller.

2. The edge pressing paper feeding device according to claim 1, wherein the constant-speed paper feeding wheel groups of said vacuum absorption constant-speed edge pressing paper feeding mechanism comprise a first row of constant-speed paper feeding wheels, a second row of constant-speed paper feeding wheels and a third row constant-speed paper feeding wheels, the three rows of constant-speed paper feeding wheels are connected by a synchronous belt to ensure that they are at the same linear speed, and a gear is arranged at an end of the second row of constant-speed paper feeding wheels, and is engaged with a gear arranged at the end of the edge pressing paper feeding wheel shaft, and the other end of the edge pressing paper feeding wheel shaft is equipped with a synchronous pulley.

3. The edge pressing paper feeding device according to claim 1, wherein said edge pressing wheels are arranged on the edge pressing paper feeding wheel shaft via a steel ball, wedge-caulking, a taper sleeve, and a compression nut, and the edge pressing paper feeding wheel shaft has a measure scale.

4. The edge pressing paper feeding device according to claim 2, wherein said edge pressing wheels are arranged on the edge pressing paper feeding wheel shaft via a steel ball, wedge-caulking and a taper sleeve, and a compression nut, and the edge pressing paper feeding wheel shaft has a measure scale.

5. The edge pressing paper feeding device according to claim 1, wherein each of said three variable-speed paper feeding wheel groups includes a servo motor and a servo controller.

6. The edge pressing paper feeding device according to claim 4, wherein each of said three variable-speed paper feeding wheel groups includes a servo motor and a servo controller.

7. The edge pressing paper feeding device according to claim 3, wherein each of said three variable-speed paper feeding wheel groups includes a servo motor and a servo controller.

* * * * *